United States Patent [19]

Ogihara et al.

[11] 4,287,586

[45] Sep. 1, 1981

[54] SIGNALING TIME DETECTING DEVICE FOR LEAF TYPE DIGITAL CLOCK

[75] Inventors: Masuo Ogihara; Kozo Chimura; Nobuo Shinozaki; Yoichi Seki, all of Shikawatashi, Japan

[73] Assignee: Seiko Koki Kabushki Kaisha, Tokyo, Japan

[21] Appl. No.: 107,517

[22] Filed: Dec. 27, 1979

[30] Foreign Application Priority Data

Dec. 28, 1978 [JP] Japan ..... 53/163740
Dec. 28, 1978 [JP] Japan ..... 53/163741

[51] Int. Cl.[3] ..... G04B 19/02; G04C 21/16
[52] U.S. Cl. ..... 368/222; 368/250
[58] Field of Search ..... 58/16 R, 16 D, 19 A, 58/38 R, 38 A; 368/72–74, 78, 222, 235, 250

[56] References Cited

U.S. PATENT DOCUMENTS 3,685,280 8/1972 Fehrenbacher ..... 58/16 D
4,175,373 11/1979 Miyamoto et al. ..... 58/16 D

*Primary Examiner*—Vit W. Miska
*Attorney, Agent, or Firm*—Robert E. Burns; Emmanuel J. Lobato; Bruce L. Adams

[57] ABSTRACT

First and second detecting wheels, the phases of which can be varied in accordance with the setting of an alarm signaling time, are provided in correspondence to an hour time wheel and a minute time wheel respectively. Among a plurality of leaves adapted for digitally indicating the minute time, some of the leaves, which occur at a constant interval of minutes, are each provided with a projection, and a third detecting means is provided to detect the presence or absence of this projection. An alarm device is actuated when the first and second detecting wheels and third detecting means are concurrently actuated.

8 Claims, 11 Drawing Figures

SIGNALING TIME DETECTING DEVICE FOR LEAF TYPE DIGITAL CLOCK

BACKGROUND OF THE INVENTION

This invention relates to time a detecting device for a leaf type digital clock and, more particularly, to improvements in or relating to the invention disclosed in Japanese patent application No. 107528/1977 filed by the same applicant.

The above Japanese patent application No. 107528/1977 discloses an alarm device, which is actuated when a first signal produced by a signaling time detection plate provided in correspondence to an hour wheel and a second signal produced by a second detecting means cooperating with a projection of one of a plurality of minute leaves occur simultaneously. The disclosed construction readily suggests the provision of two switches, respectively corresponding to the signaling time detection plate and second detecting means in the case when the former is disposed on the left side of hour leaves and the latter on the right side of minute leaves of a clock. Such a construction, however, requires an increased number of switches, and this is disadvantageous from the standpoints of economy and compactness.

SUMMARY OF THE INVENTION

Accordingly, an object of this invention is to solve the above drawback and fully realize the object of the invention disclosed in Japanese patent application No. 107528/1977 with simpler means.

According to the present invention, the aforementioned object is achieved by the provision of a first detecting lever cooperating with the signaling time detecting plate and a second detecting lever cooperating with the projections of minute leaves and capable of being driven by the first detecting lever, and permitting a switch which can operate the alarm device to be responsive to the second detecting lever.

BRIEF DESCRIPTION OF THE DRAWINGS

FIGS. 2 to 4 show some portions in the construction of FIG. 1.

DESCRIPTION OF THE PREFERRED EMBODIMENTS

Figure 1:
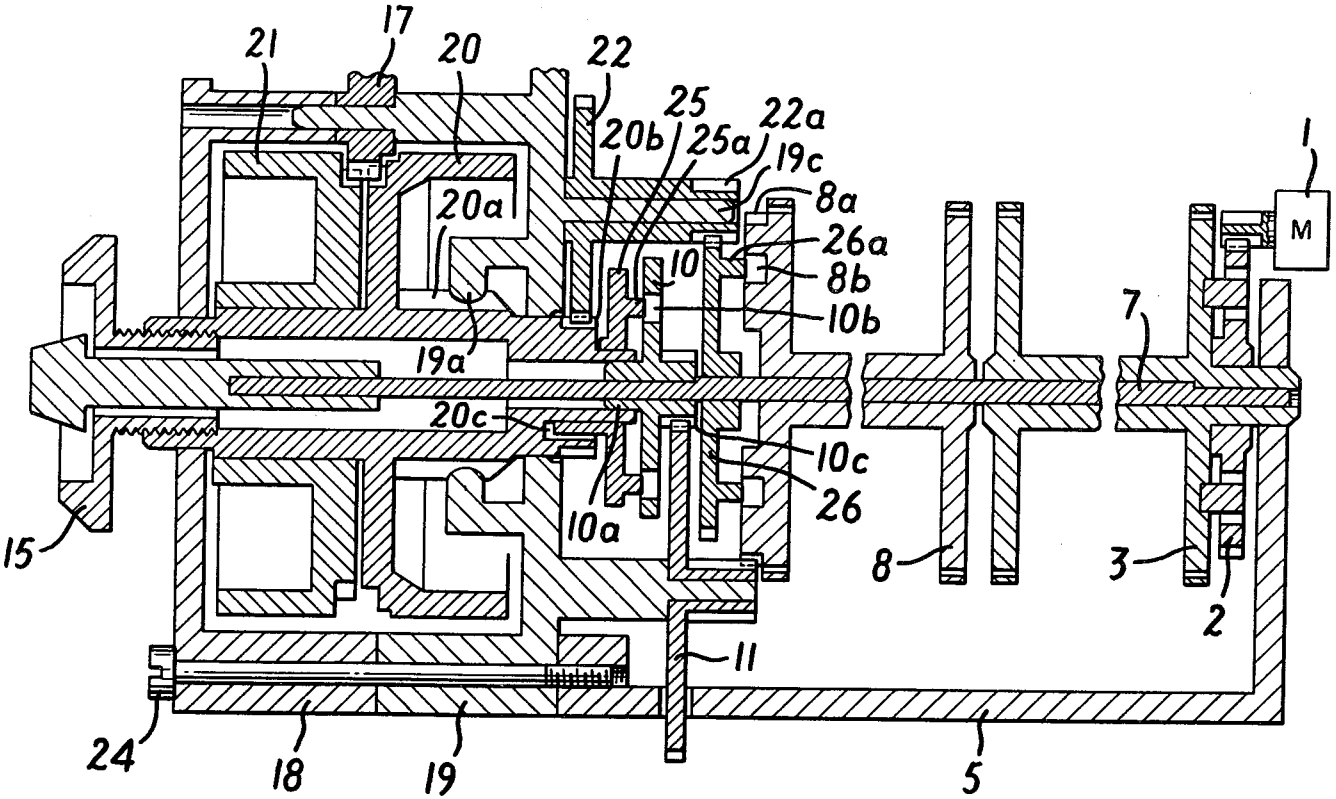
FIG. 1 is a sectional view of the main construction according to the invention.

Now, an embodiment illustrated in the appended drawings will be described below. First, the structure shown in FIGS. 1 and 2 will be described.

Figure 2:
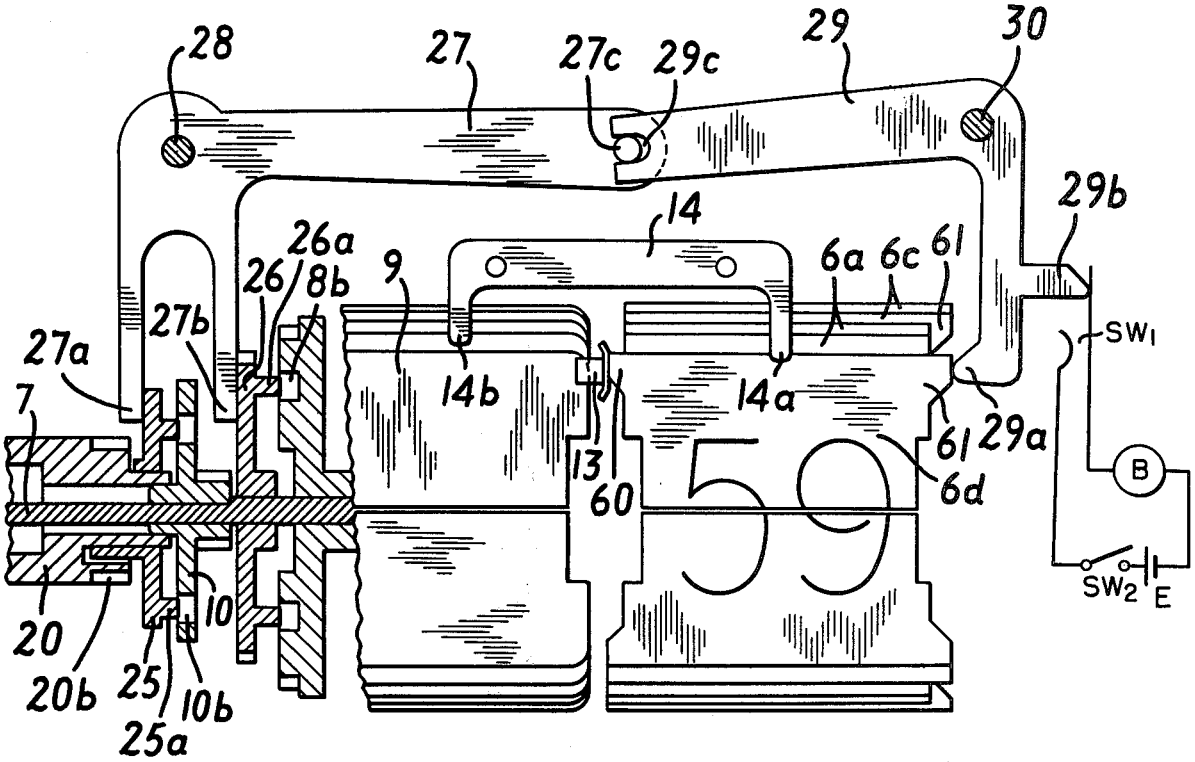

A signaling time indication mechanism will first be described. Designated at 1 is a driving motor, which is meshed with a minute wheel 2 for driving the same at a speed of one rotation per 60 minutes. The minute wheel 2 is coupled through a well-known ratchet mechanism to a minute leaf drum 3 for rotating the drum only in one direction. The minute leaf drum 3 is secured to a shaft 7. Its right hand end is journalled in a case 5, and it has 60 minute leaves. As shown in FIG. 2, these minute leaves include first minute leaves 6*a* having no projection, second minute leaves 6*b* each provided only on its left hand edge with a projection 60 (not shown), third minute leaves 6*c* each provided at the right hand edge with a projection 61 (not shown) and fourth minute leaves 6*d* each provided at both the left and right hand edges with respective projections 60 and 61 (not shown). Of these minute leaves, first minute leaves 6*a* are used when indicating "00" and "01" minutes past a given hour, third minute leaves 6*c* are used when indicating "02", "03" and "04" minutes past a given hour, first minute leaves 6*a* are again used when indicating "05" and "06" minutes past a given hour, and so on; two first minute leaves 6*a* and three third minute leaves 6*c* are combined and arranged as leaves for indicating up to "44" minutes past a given hour.

Second minute leaves 6*d* are used when indicating "45" and "46" minutes past a given hour, fourth minute leaves 6*d* are used when indicating "47", "48" and "49" minutes past a given hour, and so on; two second minute leaves 6*b* and three fourth minute leaves 6*d* are combined and arranged for indicating up to "59" minutes past a given hour.

Designated at 8 is an hour leaf drum rotatably supported by a central shaft 7, and it has 48 hour leaves 9.

A second minute wheel 10 is fixedly secured to the shaft 7 at an intermediate portion thereof, and its boss 10*a* is rotatably supported by a minute indication drum 20 which will be described later. The second minute wheel 10 has cam holes 10*b* and a pinion 10*c*. The pinion 10*c* is geared through an intermediate hour wheel 11 to an hour wheel 8*a* provided on the hour leaf drum 8.

The above hour wheel 8*a* defines cam holes 8*b* in its left side face.

Designated at 13 is an hour leaf holding spring. When an hour leaf 9 is raised in an interlocked relation to the left hand projections 60 of the second and fourth minute leaves, the hour leaf 9 is held by the spring so that it will not be inverted even if it is released from a second pawl 14*b* of a feed spring 14, and it is inverted instantaneously with the release of the fourth minute leaf 6*d* indicating "59" minutes past a given hour from a first pawl 14*a* of the feed spring, at which time "00" minute past the next hour is indicated and also the hour leaf 9 is released from the spring 13.

Figure 3A:
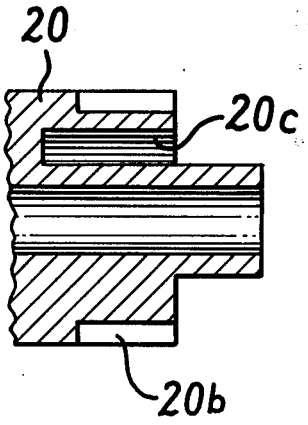
FIGS. 3*a*, 3*b*, and 4*a*, 4*b* show some portions in the construction of FIG. 1.
Figure 3B:
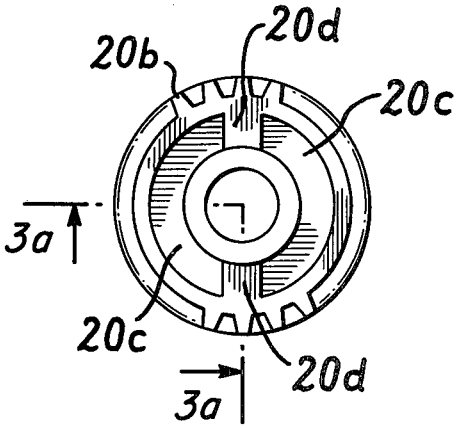

Now, a signaling mechanism will be described. Designated at 15 is a signaling time setting knob, which is coupled to a minute indication drum 20 having 60-minute scale signaling time graduations provided at an interval of 5 minutes. One end of the minute indication drum 20 is rotatably supported by an intermediate plate 19 secured by screws 24 to the case 5 and the other of the same is rotatably supported by a side plate 18 fixedly secured to the intermediate member 19. An hour indication drum 21, which is fed by one pitch with one rotation of the minute indication drum 20 through a carry gear 17, is rotatably supported on a central boss of the minute indication drum 20. The minute indication drum 20 is provided in its intermediate portion with a click gear 20*a*, which engages with a click spring 19*a* projecting from the intermediate plate 19 and provides a click stop action at an interval of, for example, five minutes when the knob 15 is rotated. It is also provided adjacent to its right hand end with grooves 20*c* and ribs 20*d* between these grooves, as shown in FIGS. 3*a* and 3*b* and a minute detection plate 25 is coupled to the minute indication drum 20 such that it is not rotatable but is movably guided in the axial direction with respect to the minute indication drum.

The minute indication member 25 has cams 25*a*, which can be received in the afore-mentioned cam holes 10*b* formed in the second minute wheel. The minute indication drum 20 is further provided adjacent to its right hand end with a pinion 20*b* which is meshed with an intermediate wheel 22 which is in turn guided for rotation by a boss 19*c* projecting from the intermediate plate. The intermediate wheel 22 has a pinion 22*a* which is rotatable with the shaft 7 and meshed with the gear of an hour detection plate 26, when guided in a movable fashion lengthwise relative to the shaft 7.

The hour detection member 26 has cams 26*a*, which can be received in the afore-mentioned cam holes 8*b* in the hour drum.

Now, a signaling time detecting mechanism shown in FIG. 2 will be described. Designated at 27 is a first detecting lever, which is rotatable about a pin 28 and has first and second arms 27*a* and 27*b* respectively adapted to cooperate with the afore-mentioned minute and hour detection plates 25 and 26 and also a pin 27*c* to be described later. Designated at 29 is a second detecting lever, which is rotatable about a pin 30 and has a first arm 29*a* adapted to cooperate with the right hand projections of the third and fourth minute leaves 6*c* and 6*d*. Its other end is provided with a groove 29*c* which is in engagement with a pin 27*c* projecting from the first detecting lever. The first arm of the second detecting lever is provided at an intermediate portion with a projection 29*b*, which is adapted to cooperate with a first switch $SW_1$ to be described later.

A second switch $SW_2$ is a so-called alarm stopping switch, and it is closed when the user wants to use a buzzer B. The switches $SW_1$ and $SW_2$ as well as buzzer B are connected in series to a power supply E.

Figure 4A:
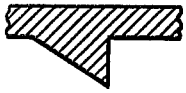
Figure 4B:
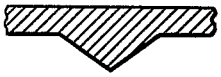

The operation of the above described structure will now be described. When the alarm signaling device is wanted to be used, the second switch $SW_2$ is first closed, and then the desired alarm time is set by turning the knob 15 while watching the figures inscribed in the minute and hour indication drums 20 and 21. At this time, if the cams 25*a* and 26*a* provided on the minute and hour detection plates 25 and 26 are arranged, as shown in FIG. 4*a*, to have a perpendicular profile on one side, the knob can be turned only in one direction. If the cams have a profile as shown in FIG. 4*b*, slanted on the opposite sides, the knob can be rotated in both forward and backward directions.

With the setting of the signaling time the alarm phases of the cams 25*a* and 26*a* of the minute and hour indication plates 25 and 26 are determined. When the clock is left in this state, the motor 1 rotates the minute wheel 2, minute leaf drum 3 and second minute wheel 10 and also rotates the hour leaf drum 8 through the intermediate hour wheel 11.

In the course of the above operation, the cam holes 8*b* of the hour leaf drum 8 and the cams 26*a* of the hour detection member 26 first come to coincidence, i.e. in phase with one another, so that the hour detection plate 26 is now capable of being moved in the rightward direction by the force of the first switch $SW_1$ through the first detecting lever 27. At this time, however, the cams 25*a* of the minute detection plate and the cam holes 10*b* of the second minute wheel are not yet brought into coincidence, i.e. in phase with one another, and thus the rotation of the first detecting lever 27 is not caused prevented. Thus, the first switch $SW_1$ still remains open.

With further rotation of the hour wheel the cams 25*a* of the minute detection plate 25 eventually come into phase with the cam holes 10*b* of the second minute wheel 10. At this time, the minute detection plate 25 is capable of being moved rightwards. However, the tip of the arm of the second detecting lever at this time cooperates with the right hand projection of the third or fourth minute leaf 6*c* or 6*d* and is thus incapable of rotation as shown in FIG. 2, so that the first switch $SW_1$ remains "off". Thus, the buzzer B is not operated yet.

When the leaf indicating "59" minutes past a given hour, as shown in FIG. 2, is inverted to "00", there is no longer any projection restricting the second detecting lever. As a result, the first and second detecting levers are rotated by the force of the first switch $SW_1$ to close the first switch $SW_1$, whereby the buzzer B is operated. At this time, the operation of the buzzer B can be stopped by opening the second switch $SW_2$.

If the buzzer B is left sounding without stopping it, after a lapse of a couple of minutes from the triggering of the buzzer B the second detecting lever is raised again by the projection of the third minute leaf 6*c*, and as a result the associated first switch $SW_1$ is opened to stop the buzzer B temporarily. After a further lapse of time, for example "05" minutes past the given hour, the projection again has moved away, thus causing a clockwise rotation of the second detecting lever to close the first switch $SW_1$ and cause the buzzer B to sound again. In this way, if the measure of stopping the buzzer sound is not taken, the buzzer B is repeatedly caused to sound for every five minutes until the cams 25*a* of the minute detection plate leave the cam holes 10*b* of the second minute wheel.

While in the above embodiment the first and second detecting levers 27 and 29 are coupled together by the engagement between pin 27*c* and groove 29*c*, it may also be feasible to construct them in such a way that the pin 27*c* of the first detecting lever 27 is adapted to follow the back side of the second detecting lever 29. Also, while in the above embodiment the first switch $SW_1$ is adapted to cooperate with the second detecting lever 29, similar effects may also be obtained by adapting the switch to cooperate with the first detecting lever (27).

Figure 5:
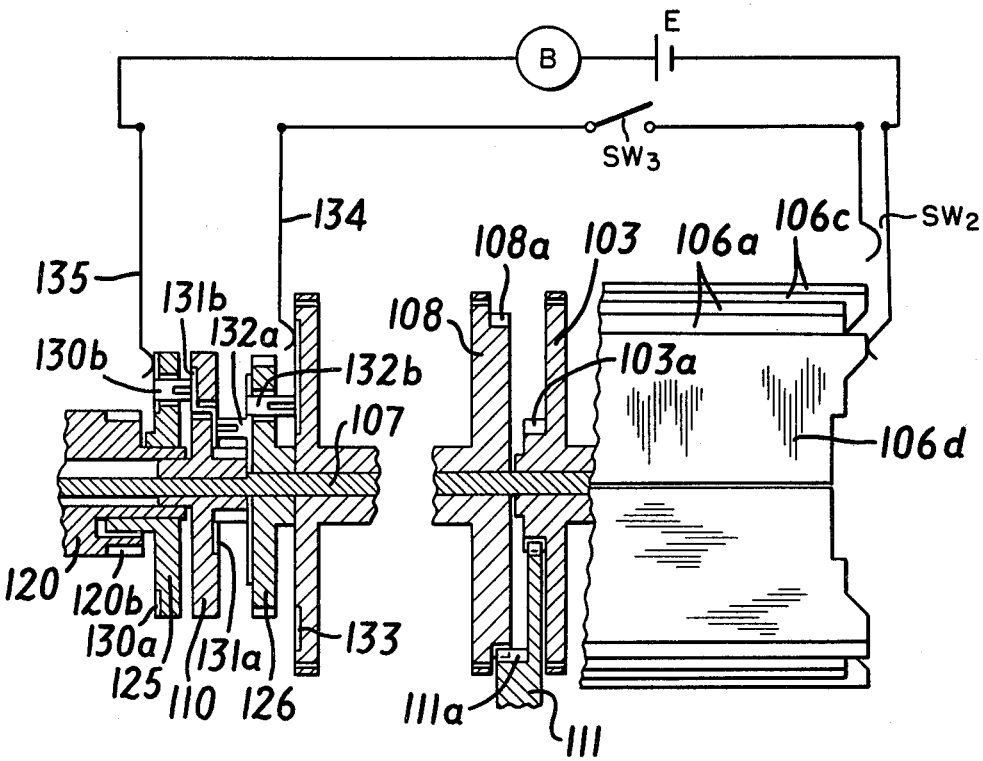
FIG. 5 is a sectional view showing the main construction of a second embodiment.
Figure 6D:
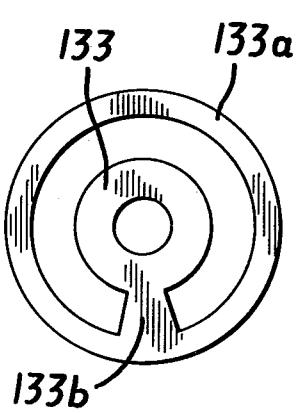
FIGS. 6*a*–6*d* show a portion of the construction of FIG. 5.
Figure 6C:
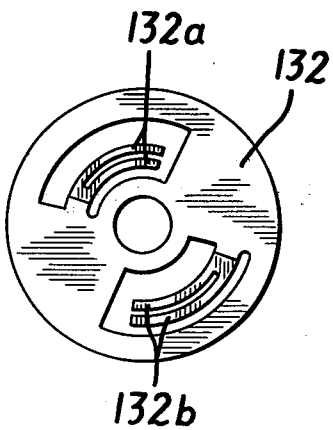

A second embodiment shown in FIGS. 5 and 6*a* -6*b* will now be described.

This embodiment is different from the first embodiment in the hour leaf drum feed mechanism and alarm signaling time detection mechanism, and these different portions will be described.

In the alarm signaling time indicating mechanism, a minute leaf drum 103 having minute leaves 106*a* to 106*d* similar to those in the first embodiment is provided at the left hand end with an integral pinion 103*a* which meshes with an intermediate hour wheel 111. An hour leaf drum 108 is also provided at its right hand end with an hour hand wheel 108*a* meshing with a pinion 111*a* provided on the intermediate hour wheel 111.

Now, the alarm signaling time indicating mechanism will be described. Designated at 125 is a minute detection member which is integral with a minute indication drum 120 like the first embodiment. It has a first switch member 130 as shown in FIG. 6*a*, which is secured to the surface of the minute detection member 125. The first switch member 130 has a disc portion 130*a* which is always in contact with a slide contact piece 135 of a first switch $SW_1$ and a contact arm 130*b* extending rightwards through a hole formed in the minute detection member 125.

Figure 6B:
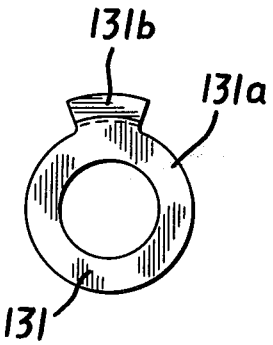
Figure 6A:
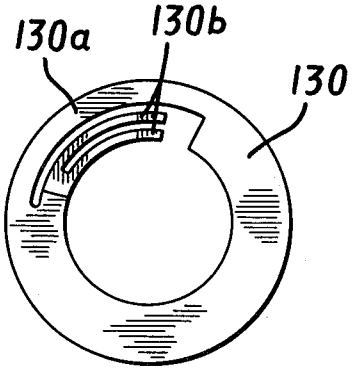

Designated at 110 is a second minute wheel secured to a shaft 107, and it has a second switch member 131 as shown in FIG. 6*b*, secured to its surface. The second switch member 131 has a disc portion 131*a* and a sector-shaped switch section 131*b* penetrating and extending parallel to the left hand side of the second minute hand wheel 110. The sector-shaped switch section 131*b* is capable of being brought into contact with the contact arm 130*b* of the first switch member. Designated at 126 is an hour detection member which is coupled through a second intermediate hour wheel (not shown) to a pinion 120*b* of the minute indication drum like the first embodiment, and it has a third switch member 132 as shown in FIG. 6*c*, secured to its surface. The third switch member 132 has a first contact arm 132*a* extending leftwards and always in contact with the disc portion of the first switch member and a second contact arm 132*b* penetrating and rightwardly extending through a hole in the hour detection member 126. The hour leaf drum 108 has a fourth switch member 133 as shown in FIG. 6*d*, secured to the left side of the drum. The fourth switch member 133 has a disc portion 133*a* which is always in contact with a contact piece 134 of the first switch $SW_1$ and a sector-shaped switch section 133*b* capable of being brought into contact with the second contact arm 132*b* of the third switch member. The first switch $SW_1$ is connected in series with a second switch $SW_2$, a manually operable third switch and a buzzer B across a power supply E as in the first embodiment.

In operation, when an alarm signaling time which has been previously set is approached as the clock is being driven, the sector-shaped switch section 133*b* of the fourth switch member 133 is first brought into contact with the second contact arm 132*b* of the third switch member. At this time, the second switch member 131 and first switch member 130 are not yet in contact with each other, so that the buzzer B is not operated yet. When the preset alarm signaling time is further approached, the sector-shaped switch section 131*b* of the second switch member is brought into contact with the contact arm 130*b* of the first switch member, whereby the two slide contact pieces 135 and 134 are electrically connected to each other through the hour switch member 130-133.

As a result, the first switch $SW_1$ is closed. However, the second switch $SW_2$ is held raised at this time by the right hand projection 161 of the corresponding minute leaf and is not closed, so that the buzzer B is not operated yet.

When the alarm signaling time is reached, causing the movement of the fourth minute leaf 106*d*, the second switch $SW_2$ is no longer restricted by any projection on the minute leaves so that it closes itself by its own force. With the closure of the second switch $SW_2$ the whole circuit loop is closed, whereby the buzzer B is operated. The subsequent operation is the same as in the case of the first embodiment, so that it is not described here.

As has been described, according to the invention not only the afore-mentioned object is achieved, but also it is possible to permit the alarm signaling time to be set by turning the knob 15 in either direction since an alarm signaling time indicating device with an accuracy of $\pm 0$ minute can be realized by forming, for instance cams which do not have a perpendicular profile but have a triangular profile or providing slide switches as in the second embodiment.

What is claimed is:

1. In a signaling time detecting device for a leaf type digital clock, including a hour time wheel and a detection plate which corresponds to said hour time wheel and whose phase changes in accordance with the setting of an alarm signaling time so as to move said detection plate in order to actuate an alarm device when said hour time wheel and detection plate are brought into coincidence in phase with each other, said time detecting device comprising: a first detecting lever adapted to cooperate with said detection plate; a projection provided on each of some of a plurality of minute leaves, said some leaves occurring at a constant interval; a second detecting lever adapted to cooperate with any one of the projections and to be driven by said first detecting lever; and a switch adapted for rendering the alarm device operable in response to the action of either said first or second detecting lever.

2. The signaling time detecting device according to claim 1, said detection plate corresponding to an hour time wheel and being rendered movable when said first detection plate and said hour time wheel are brought into coincidence in phase with each other; further comprising a second detection plate corresponding to a minute time wheel and being rendered movable in the same direction as said first-mentioned detection plate when said second detection plate and said minute time wheel are brought into coincidence in phase with each other; and said first detecting lever having two arms respectively cooperating with said first and second detection plates.

3. The signaling time detecting device according to claim 1 or 2, wherein said first and second detecting levers are coupled together at ends thereof respectively formed as a pin and a groove.

4. The alarm signaling time detecting device according to claim 2, further comprising; said first detecting lever having arms adapted to cooperate with said first and second detecting plates and said second detecting lever adapted to cooperate with said projection of each minute leaf, both detecting levers being coupled together; and a switch for starting the alarm device, said switch being adapted to cooperate with either one of said detecting levers.

5. In a leaf type digital alarm clock, the combination comprising: a minute leaf drum mounted for rotation; minute leaves on said minute leaf drum for visually displaying minutes as said minute leaf drum rotates, wherein at least one of said minute leaves has a protrusion extending from a marginal edge thereof; an hour leaf drum mounted for rotation; hour leaves on said hour leaf drum for visually displaying hours as said hour leaf drum rotates; a detection plate positionable at different positions corresponding to different alarm times, said detection plate cooperative with said hour leaf drum for shifting position when the hours displayed by said minute leaves are the same as the hours of the alarm time corresponding to the position of said detection plate; a first detecting lever mounted for pivotal movement and having a first end positioned by said detection plate and having a second end; a second detecting lever mounted for pivotal movement and having a first end positioned by a protrusion of the minute leaf being displayed and having a second end engaged with the second end of said first detecting lever, said first and said second detecting levers being positioned such that said first detecting lever prevents said second detecting lever from being released and pivoting in a direction to move said first end of said second detecting lever toward said minute leaves before said detection plate has shifted position, and such that said second detecting lever prevents said first detecting lever from being released and pivoting in a direction to move said first end of said first detecting lever toward said detection plate before said second detecting lever first end has been released from the protrusion of the minute leaf being displayed; and alarm means including a switch controlled by one of said detecting levers for emitting an alarm signal when the one of said detecting levers is released.

6. In a leaf type digital alarm clock according to claim 5:

a plurality of said minute leaves having a protrusion extending from a marginal edge thereof for controlling said second detection lever, said plurality of minute leaves having a protrusion are distributed at regular intervals among said minute leaves, and said minute leaves including those having a protrusion are effective to intermittently operate said switch for intermittently emitting an alarm signal.

7. In a leaf type digital alarm clock according to claim 5: said detection plate having a surface facing said hour leaf drum with protrusions extending from said detection plate surface toward said hour leaf drum; said hour leaf drum having recesses positioned for receiving said protrusions when said hour leaf drum has rotated to display the hours of the alarm time corresponding to the position of said detection plate; said detection plate shifting position to insert said protrusions into the recesses in said hour leaf drum when said protrusions and the recesses are in correspondence; a second detection plate positionable at different positions corresponding to the minutes of different alarm times; a minute wheel adjacent said second detection plate and driven in synchronism with the rotation of said minute leaf drum; said second detection plate having protrusions extending toward said minute wheel, and said minute wheel having recesses positioned for receiving said protrusions when said minute leaf drum has rotated to display the minutes of the alarm time corresponding to the position of said second detection plate; said second detection plate shifting position to insert its protrusions into the recesses in said minute wheel when the second detection plate protrusions and the minute wheel recesses are in correspondence; and the first end of said first detecting lever comprising a pair of arms respectively positioned by the first-mentioned and said second detection plates for preventing said first detecting lever from pivoting to release said second detecting lever until both of said detection plates have shifted.

8. In a leaf type digital alarm clock according to claim 5, 6 or 7: said switch being normally closed and positioned for being held in an open condition by one of said detecting levers when said detecting levers are in the unreleased condition; and said switch when held in the open condition comprising biasing means for biasing said detecting levers from the unreleased to the released condition.

* * * * *